US009200510B2

(12) United States Patent
Heisig et al.

(10) Patent No.: US 9,200,510 B2
(45) Date of Patent: Dec. 1, 2015

(54) SYSTEM AND METHOD FOR ESTIMATING DIRECTIONAL CHARACTERISTICS BASED ON BENDING MOMENT MEASUREMENTS

(75) Inventors: Gerald Heisig, Lower Saxony (DE); John D. Macpherson, Spring, TX (US)

(73) Assignee: Baker Hughes Incorporated, Houston, TX (US)

( * ) Notice: Subject to any disclaimer, the term of this patent is extended or adjusted under 35 U.S.C. 154(b) by 586 days.

(21) Appl. No.: 13/191,124

(22) Filed: Jul. 26, 2011

(65) Prior Publication Data

US 2012/0046865 A1 Feb. 23, 2012

Related U.S. Application Data

(60) Provisional application No. 61/374,795, filed on Aug. 18, 2010.

(51) Int. Cl.
*G01V 1/40* (2006.01)
*E21B 47/024* (2006.01)
*E21B 47/00* (2012.01)

(52) U.S. Cl.
CPC ..... *E21B 47/024* (2013.01); *E21B 47/0006* (2013.01)

(58) Field of Classification Search
CPC ..... E21B 47/0006; E21B 47/024
USPC ..... 702/6; 175/45, 61; 33/313
See application file for complete search history.

(56) References Cited

U.S. PATENT DOCUMENTS 5,465,799 A * 11/1995 Ho ..... 175/61
5,608,162 A 3/1997 Ho
6,631,563 B2 * 10/2003 Brosnahan et al. ..... 33/313
6,672,406 B2 * 1/2004 Beuershausen ..... 175/57
7,503,403 B2 * 3/2009 Jogi et al. ..... 175/45
2004/0107590 A1 * 6/2004 Russell et al. ..... 33/313
2005/0240350 A1 * 10/2005 Engebretson et al. ..... 702/6
2005/0268476 A1 * 12/2005 Illfelder ..... 33/313
2006/0090934 A1 * 5/2006 Williams ..... 175/45
2007/0032958 A1 * 2/2007 Chen ..... 702/14

(Continued)

OTHER PUBLICATIONS

Notification of Transmittal of the International Search Report and the Written Opinion of the International Searching Authority, or the Declaration; PCT/US2011/048211; Mar. 5, 2012.

Howes, Thomas, et al. "Real-Time Well Tool Face Information Reduces Directional Uncertainty and Risks in Difficult Sidetracks in Gulf of Suez", IADC/SPE 128520, Feb. 2-4, 2010, 10 Pages, Society of Petroleum Engineers, USA.

(Continued)

*Primary Examiner* — Janet Suglo
*Assistant Examiner* — Stephanie Bloss
(74) *Attorney, Agent, or Firm* — Cantor Colburn LLP

(57) ABSTRACT

A system for measuring directional characteristics of a downhole tool includes: at least one bending moment (BM) measurement device disposed at a downhole component, the at least one BM measurement device configured to generate bending moment data at at least one depth in the borehole, the bending moment data including a bending vector of the downhole tool, a bending moment representing an amplitude of the bending vector, and a bending tool face (BTF) angle representing an orientation of the bending vector; and a processor in operable communication with the BM measurement device and configured to receive bending moment data from the BM measurement device, calculate a dogleg severity (DLS) from the bending moment and a well tool face (WTF) angle from the BTF angle, and calculate at least one of a change in inclination and a change in azimuth based on the DLS and the WTF angle.

22 Claims, 7 Drawing Sheets

(56) References Cited

U.S. PATENT DOCUMENTS

| | | | | |
|---|---|---|---|---|
| 2009/0000780 | A1 | 1/2009 | Wells et al. | |
| 2010/0270077 | A1 * | 10/2010 | Huynh et al. | 175/57 |

OTHER PUBLICATIONS

McElhinney, G.A. et al, "Gravity Azimuth: A New Technique to Determine Your Well Path, Conference" IADC/SPE 59200, Feb. 23-25, 2000, 15 pages, Society of Petroleum Engineers, USA.

Heisig, G et al., "Downhole Diagnosis of Drilling Dynamics Data Provides New Level Drilling Process Control to Driller," Conference Paper, Sep. 27-30, 1998, 10 pages, SPE 49206, Society of Petroleum Engineers, USA.

Stockhausen, E.J. et al., Continuous Direction and Inclination Measurements Lead to an Improvement in Wellbore Positioning, Conference Paper, Feb. 19-21, 2003, 16 pages, SPE?IADC 79917, Society of Petroleum Engineers, USA.

Heisig, G et al., Continuous Borehole Curvature Estimates While Drilling Based on Downhole Bending Moment Measurements, Sep. 26-29, 2004, 14 Pages, SPE90794, Society of Petroleum Engineers, USA.

* cited by examiner

Microsoft Excel – Bending TF Calculation.xls

File Edit View Insert Format Tools Data Window Help

E18

Reply with changes... End Review...

Arial 10 100%

| | A | B | C | D | E | H | I |
|---|---|---|---|---|---|---|---|
| 1 | | | | | | | |
| 2 | | | | | | | |
| 3 | | $BTF=GTF+TF_{offset}-btf$ <br> $BTF=GTF+TF_{offset}-\tan^{-1}\left(\frac{by}{bx}\right)$ | | | Bending Toolface Calculation | | |
| 4 | BTF= | Bending Toolface in Gravity Highside System | | | | | |
| 5 | GTF= | Gravity Toolface from OnTrak | | | | | |
| 6 | TF offset= | Offset between Ontrak and CoPilot coordinate systems | | | | | |
| 7 | btf= | Bending Toolface in CoPilot coordinate system [btf= atan(by/bx)] | | | | | |
| 8 | | | | | | | |
| 9 | 1) | | | | | | |
| 10 | Offset [deg] | 135 | | | | | |
| 11 | Bias X | 0 | | | | | |
| 12 | Bias Y | 0 | | | | | |
| 13 | | | | | | | |
| 14 | 2) | | | | | | |
| 15 | | | Input | | | Output | |
| 16 | Time | Measured Depth | DBMXAX | DBMYAX | HTFX | Bending Toolface | Bending Moment |
| 17 | 12:43:00 | 320 | 5000 | −3000 | 87 | −107.0362435 | 5830.951895 |

FIG. 9

SYSTEM AND METHOD FOR ESTIMATING DIRECTIONAL CHARACTERISTICS BASED ON BENDING MOMENT MEASUREMENTS

CROSS REFERENCE TO RELATED APPLICATIONS

This application claims the benefit of an earlier filing date from U.S. Provisional Application Ser. No. 61/374,795 filed Aug. 18, 2010, the entire disclosure of which is incorporated herein by reference.

BACKGROUND

In directional drilling practice, the course of a wellbore is determined by measuring downhole the direction of the wellbore with inclinometers and magnetometers at discrete survey points, mostly taken after drilling one stand of pipe and making a connection. The directional sensors provide an inclination angle $\alpha$ with respect to vertical and an azimuth angle $\beta$ with respect to magnetic North. Complemented with the measured depth at the survey points, a series of survey stations may be obtained. In most directional applications, the minimum curvature method is applied to calculate the course of the wellbore from the survey stations. The minimum curvature method assumes a circular arc between the survey stations with constant curvature or constant dogleg severity (DLS). Additional effects such as local curvature variations can generate significant depth errors, in particular with steerable motor systems if operated alternately in sliding and rotating mode between the survey stations. In addition, standard directional sensors can be affected by magnetic interference, either from near-by wells or in casing exit operations.

SUMMARY

A system for measuring directional characteristics of a downhole tool includes: at least one bending moment (BM) measurement device disposed at a downhole component that is configured to be movable within a borehole, the at least one BM measurement device configured to generate bending moment data at at least one depth in the borehole, the bending moment data including a bending vector of the downhole tool, a bending moment representing an amplitude of the bending vector, and a bending tool face (BTF) angle representing an orientation of the bending vector; and a processor in operable communication with the BM measurement device and configured to receive bending moment data from the BM measurement device, calculate a dogleg severity (DLS) from the bending moment and a well tool face (WTF) angle from the BTF angle, and calculate at least one of a change in inclination and a change in azimuth based on the DLS and the WTF angle.

A method of measuring directional characteristics of a downhole tool includes: disposing a downhole component in a borehole in an earth formation, the downhole component operably coupled to at least one bending moment (BM) measurement device; generating bending moment data via the at least one BM measurement device at at least one depth in the borehole, the bending moment data including a bending vector of the downhole tool, a bending moment representing an amplitude of the bending vector, and a bending tool face (BTF) angle representing an orientation of the bending vector; receiving bending moment data from the BM measurement device at a processor; calculating a dogleg severity (DLS) from the bending moment and a well tool face (WTF) angle from the BTF angle; and calculating at least one of a change in inclination and a change in azimuth based on the DLS and the WTF angle.

BRIEF DESCRIPTION OF THE DRAWINGS

The following descriptions should not be considered limiting in any way. With reference to the accompanying drawings, like elements are numbered alike:

FIG. 9 is an illustration of a spreadsheet program used to estimate BTF angles.

DETAILED DESCRIPTION

The systems and methods described herein provide for estimating or calculating various directional characteristics from bending moment measurements in a downhole component. In one embodiment, a well tool face angle (WTF) and/or bending tool face angle (BTF) is derived from bending moment sensors in a downhole tool. For example, The BTF angle is estimated from orthogonal bending moment measurements, and the WTF angle is estimated from the BTF angle. In one embodiment, inclination and/or azimuth angle changes in a borehole are estimated based on a dogleg severity (DLS) derived from bending moment measurements and the WTF angle. Both the DLS and the WTF may be estimated using measurements from a pair of orthogonal bending moment sensors which are both perpendicular to a borehole axis and to each other.

Figure 1:
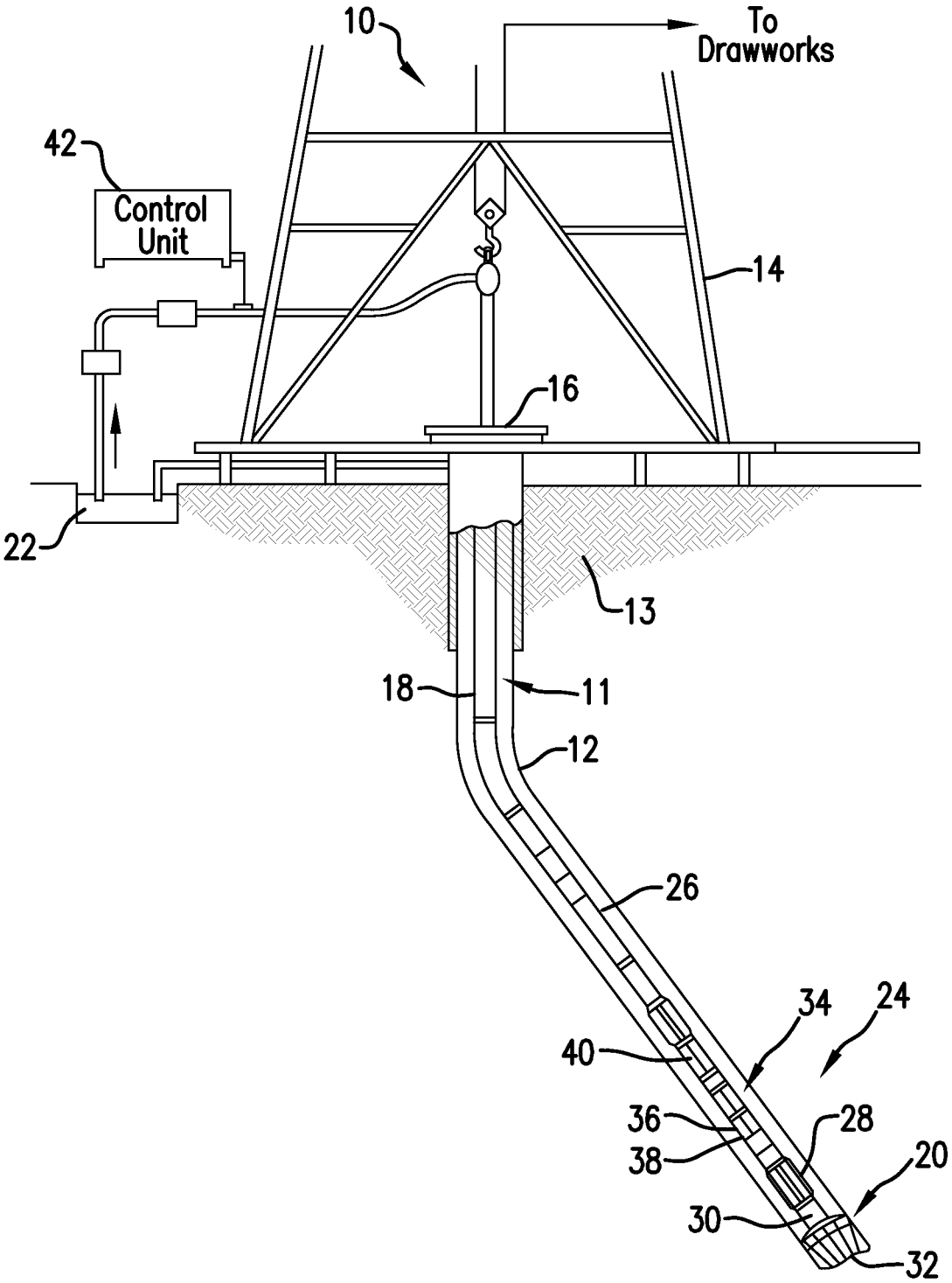
FIG. 1 is a side cross-sectional view of an embodiment of a drilling and/or geosteering system.

Referring to FIG. 1, an exemplary embodiment of a well drilling, logging and/or geosteering system 10 includes a drillstring 11 that is shown disposed in a wellbore or borehole 12 that penetrates at least one earth formation 13 during a drilling operation and makes measurements of properties of the formation 13 and/or the borehole 12 downhole. As described herein, "borehole" or "wellbore" refers to a single hole that makes up all or part of a drilled well. As described herein, "formations" refer to the various features and materials that may be encountered in a subsurface environment and surround the borehole.

In one embodiment, the system 10 includes a conventional derrick 14 that supports a rotary table 16 that is rotated by a prime mover at a desired rotational speed. The drillstring 11 includes one or more drill pipe sections 18 that extend downward into the borehole 12 from the rotary table 16, and is connected to a drilling assembly 20. Drilling fluid or drilling mud 22 is pumped through the drillstring 11 and/or the borehole 12. The well drilling system 10 also includes a bottomhole assembly (BHA) 24.

The drilling assembly 20 is powered by a surface rotary drive, a motor using pressurized fluid (e.g., a mud motor), an electrically driven motor and/or other suitable mechanism. In one embodiment, a drill motor or mud motor 26 is coupled to the drilling assembly 20 via a drive shaft disposed in a bearing assembly 28 that rotates the drill bit assembly 20 when the drilling fluid 22 is passed through the mud motor 26 under pressure.

In one embodiment, the drilling assembly 20 includes a steering assembly including a shaft 30 connected to a drill bit 32. The shaft 30, which in one embodiment is coupled to the mud motor, is utilized in geosteering operations to steer the drill bit 32 and the drillstring 11 through the formation.

In one embodiment, the drilling assembly 20 is included in the bottomhole assembly (BHA) 24, which is disposable within the system 10 at or near the downhole portion of the drillstring 11. The system 10 includes any number of downhole tools 34 for various processes including formation drilling, geosteering, and formation evaluation (FE) for measuring versus depth and/or time one or more physical quantities in or around a borehole. The tool 34 may be included in or embodied as a BHA, drillstring component or other suitable carrier. A "carrier" as described herein means any device, device component, combination of devices, media and/or member that may be used to convey, house, support or otherwise facilitate the use of another device, device component, combination of devices, media and/or member. Exemplary non-limiting carriers include drill strings of the coiled tubing type, of the jointed pipe type and any combination or portion thereof. Other carrier examples include casing pipes, wirelines, wireline sondes, slickline sondes, drop shots, downhole subs, bottom-hole assemblies, and drill strings.

In one embodiment, the tool 34 includes sensor devices configured to measure directional characteristics at various locations along the borehole 12. Examples of such directional characteristics include inclination and azimuth, from which dogleg severity (DLS) may be derived. The tool 34, or another tool, may include sensors for measuring the bending moment (BM), the bending tool face (BTF) angle, and the well tool face (WTF) angle. For example, the tool 34 includes one or more sensors 36, 38 for measuring bending moments, such as strain gauge or strain gauge assemblies (e.g., a Wheatstone Bridge circuit). Other sensors may include an inclinometer 40 configured to provide inclination data. Although the sensor devices are shown in conjunction with the tool 34 in FIG. 1, the sensor devices are not so limited and may be included with any desired downhole components such as the drill string 11 or other borehole string, the BHA 24 and the drilling assembly 20.

Figure 2:
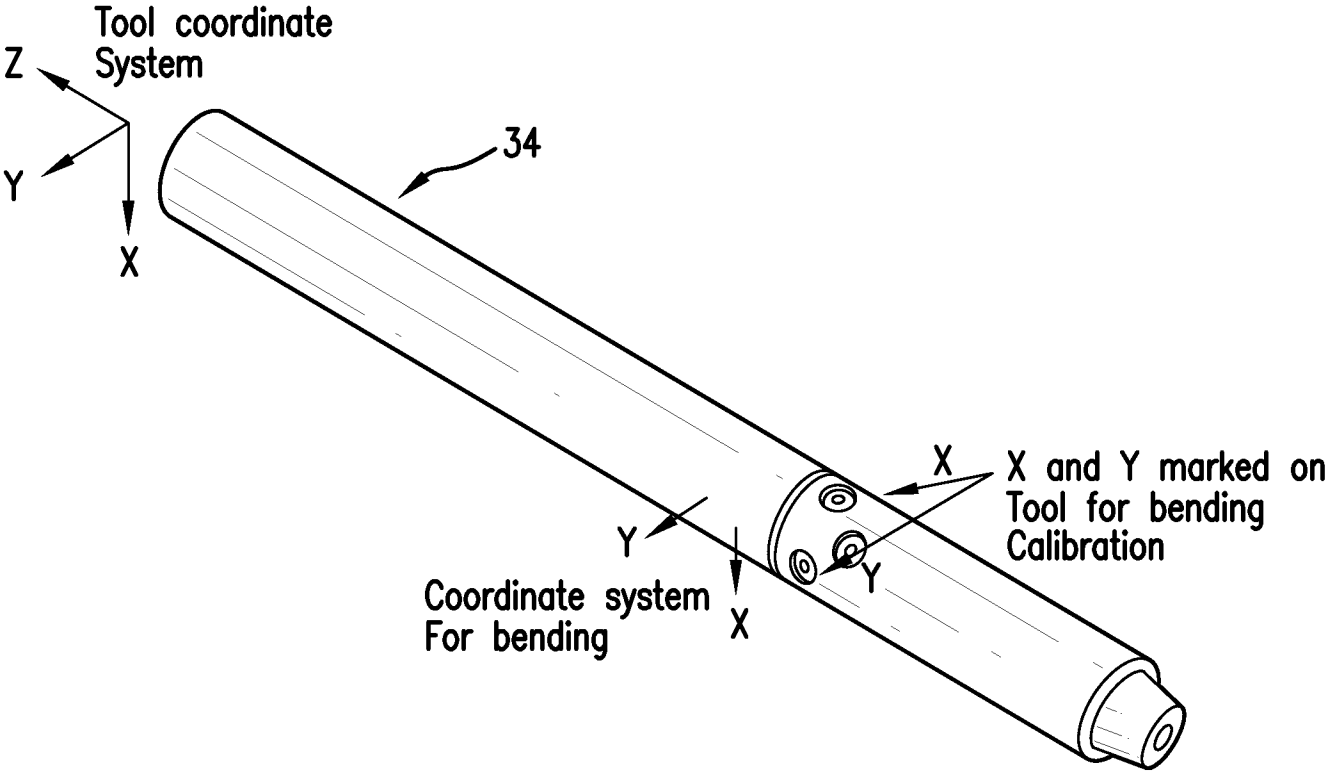
FIG. 2 is a perspective view of a downhole tool for measuring bending moment at a location in a drill string.

An example of the tool 34 is shown in FIG. 2. An exemplary orthogonal coordinate system includes a z-axis that corresponds to the longitudinal axis of the tool 34, and perpendicular x- and y-axes. In one embodiment, the sensor devices are configured to take two independent perpendicular bending moment measurements at selected cross-sectional locations of the tool 34. The tool 34 may include bending measurement sensors 36, 38 (e.g., strain gauges) in a bottomhole assembly or other drillstring component, or a bending measurement sonde disposed in the tool 34. The position of the bending measurement sensors is shown on the tool 34 by markings, indentations or other indications "X" and "Y" indicating the angular positions of the measurement sensors 36, 38 located on the x-axis and y-axis, respectively. For example, the X marking shows the angular position of a strain gauge 36 and the Y marking shows an angular position of a strain gauge 38.

Referring again to FIG. 1, in one embodiment, the tool 34 includes and/or is configured to communicate with a processor to receive, measure and/or estimate bending moment measurements. For example, the tool 34 is equipped with transmission equipment to communicate ultimately to a surface processing unit 42. In one embodiment, the surface processing unit 42 is configured as a surface drilling control unit which controls various drilling parameters such as rotary speed, weight-on-bit, drilling fluid flow parameters and others and records and displays real-time formation evaluation data. Such transmission equipment may take any desired form, and different transmission media and connections may be used. Examples of connections include wired, fiber optic, acoustic, wireless connections and mud pulse telemetry.

In one embodiment, the surface processing unit 42 and/or the tool 34 include components as necessary to provide for storing and/or processing data collected from various sensors therein. Exemplary components include, without limitation, at least one processor, storage, memory, input devices, output devices and the like. The surface processing unit 42 optionally is configured to control the tool 34.

The tool 34 and/or the surface processing unit 42 are configured to estimate various directional characteristics based on bending moment (BM) measurements, which are derived, for example, from orthogonal strain gauges. The orthogonal bending moment measurements are referred to as "BM_x" and "BM_y". The total bending moment can be obtained simply as the vector sum of these two measurements:

$$\text{Total BM}=((\text{BM_}x)^2+(\text{BM_}y)^2)^{1/2}. \quad (1)$$

In one embodiment, the tool 34 and/or the surface processing unit 42 are configured to estimate various directional characteristics, such as an inclination, a change in inclination, an azimuth and a change in azimuth. For example, an inclination and an azimuth can be estimated based on well tool face (WTF) angle and dogleg severity (DLS) measurements.

DLS can be estimated from the total bending moment derived from two perpendicular bending moment measurements. DLS may be calculated using suitable models based on previous borehole measurements that describe the relationship between bending moment and DLS. The relationship between bending moment and DLS is predicted using, for example, a finite element model of the tool 34 that takes into account the influence of flexible tool elements and stabilizers in the direct vicinity of a measurement point. Such models take into account these influences so that differences in tool curvature, which are calculated based on BM measurements of the tool 34, and borehole curvature can be taken into account.

WTF angle may also be estimated based on perpendicular BM measurements. Various mathematical models derived from borehole measurements may be used to estimate WTF. In one embodiment, the WTF is estimated from a bending tool face (BTF) angle which can also be derived from two perpendicular bending moment measurements.

Figure 3A:
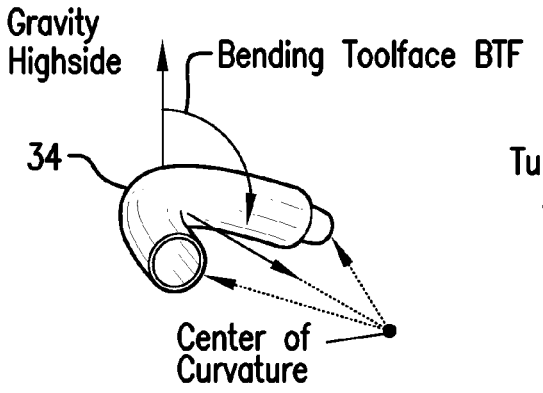
FIGS. 3A and 3B are perspective views of a downhole component showing a bending tool face (BTF) angle.
Figure 3B:
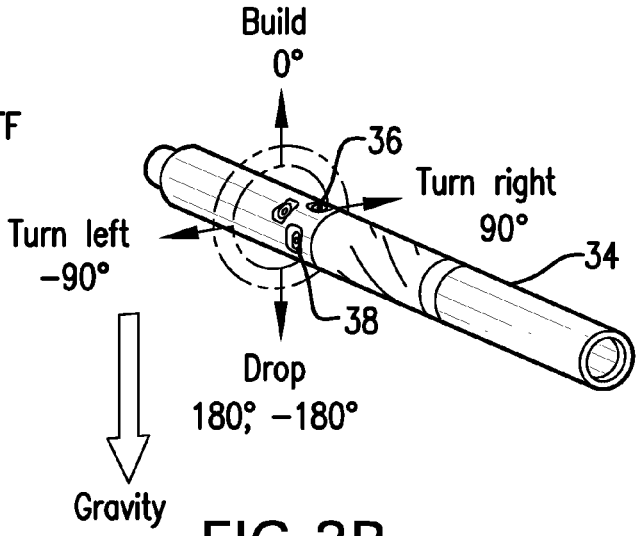

Referring to FIGS. 3A and 3B, a bending tool face angle BTF is shown with reference to gravity high side (the direction opposite the gravity vector). The BTF angle is defined as the angle between gravity high side and bending vectors (as illustrated, for example, in FIG. 3A). The BTF angle can assume values in the range of −180 degrees to +180 degrees, as shown in FIG. 3B. The BTF angle can be calculated whether the drill string 11 is operating in a rotary mode, where both the drill bit and the drill-string rotate, or in a sliding mode where only the bit rotates. For example, in the sliding mode, the BTF angle is calculated from the individual sensor measurements BM_y and BM_x as follows:

$$\text{BTF}=\text{GTF}+\text{TF_offset}-\arctan(\text{BM_}y/\text{BM_}x), \quad (2)$$

where "TF_offset" is the offset angle between the coordinate systems of directional sensors and the bending sensors 36, 38, and "GTF" denotes the rotational orientation of the tool around the longitudinal axis with respect to gravity high side.

In the rotary mode, the BTF angle may be calculated using an algorithm that includes sampling signals at high speed from orthogonal pairs of magnetometer, accelerometer and bending sensors 36, 38 in the rotating tool 34 which have the same orthogonal x, y and z axes, or which can be mathematically rotated and translated to a common orthogonal reference. The magnetometer data are processed to create an azimuthal reference, and both accelerometer and bending signals are resampled against this azimuthal reference. Filtering and processing of the accelerometer and bending signals yields two phase angles "Φaccel" and "Φbend" in reference to the azimuthal position. The BTF angle is then obtained as the difference between the two phase angles:

$$BTF=\Phi bend-\Phi accel. \tag{3}$$

In one embodiment, BTF calculations are performed periodically. For example, every five seconds a new BTF update is obtained and available for transmission uphole alongside the total bending moment BM. Further discussion of the BTF angle is included in Heisig et al., "Bending Tool Face Measurements While Drilling Delivers New Directional Information, Improved Directional Control", IADC/SPE 128789, Feb. 2, 2010, the subject matter of which is hereby incorporated by reference in its entirety.

Since the tool 34 in a borehole 12 generally follows the path of the borehole 12, the WTF angle may be derived by assuming that the BTF angle equals the WTF angle. In one embodiment, a mathematical model such as the finite element model described above is used to adjust the WTF calculation based on an offset angle between BTF and WTF that could result from potential small misalignments between the tool 34 and the borehole 12.

Based on the WTF and DLS measurements, inclination and azimuth information can be calculated based on the following relationships:

$$\alpha'=DLS\cos(WTF) \text{ and } \beta'=DLS\sin(WTF)/\sin\alpha, \tag{4}$$

wherein α' and β' are the first derivatives of the inclination α and the azimuth angle β with respect to a measured depth.

Estimation of inclination and azimuth based on WTF and DLS according to the above relationship can be shown based on the derivation of various equations through the application of differential geometry concepts. The derivation starts with the introduction of a vector "$\underline{R}$" which describes a center line of a directional wellbore as a function of an arc length "s" on the center of the borehole axis:

$$\underline{R}(s)=R_1(s)\underline{I}_1+R_2(s)\underline{I}_2+R_3(s)\underline{I}_3, \tag{5}$$

where the arc length s is the measured depth of the borehole, $R_1(s)$ is the North departure, $R_2(s)$ is the East departure, $R_3(s)$ is the true vertical depth (TVD), and $\underline{I}_1$, $\underline{I}_2$ and $\underline{I}_3$ are unit vectors of a fixed frame "I" at the start of the borehole with $\underline{I}_3$ pointing in the direction of gravity.

A coordinate frame "b" describing movement along the center line or arc length, also known as the Frenet trihedron, may be calculated. A borehole tangent unit vector $\underline{b}_3$ at position s is obtained as the first derivative of $\underline{R}$ ("$\underline{R}'(s)$") with respect to the arc length s:

$$\underline{b}_3(s)=\underline{R}'(s)=d\underline{R}/ds. \tag{6}$$

The tangent unit vector $\underline{b}_3$ can also be expressed with an inclination angle "α" and an azimuth angle "β" of the borehole at the position s:

$$\underline{b}_3=\sin\alpha\cos\beta\underline{I}_1+\sin\alpha\sin\beta\underline{I}_2+\cos\alpha\underline{I}_3. \tag{7}$$

Both inclination α and azimuth β are functions of the arc length s. A normal unit vector $\underline{b}_2$ perpendicular to the borehole axis and in the curvature plane is obtained with:

$$\underline{b}_2(s)=\underline{R}''(s)/|\underline{R}''(s)|, \tag{8}$$

wherein $\underline{R}''(s)$ is the second derivative of $\underline{R}$ and $|\underline{R}''(s)|$ is the absolute value of $\underline{R}''(s)$.

The third unit vector or binormal vector $\underline{b}_1(s)$ (i.e., binormal vector) of the moving frame b, is then obtained as the vector product of $\underline{b}_2$ and $\underline{b}_3$:

$$\underline{b}_1(s)=\underline{b}_2(s)\times\underline{b}_3(s). \tag{9}$$

Frenet's formula describes the change of the coordinate system b while moving along the borehole axis:

$$\underline{b}_1'=-\tau\underline{b}_2$$

$$\underline{b}_2'=+\tau\underline{b}_1-\kappa\underline{b}_3$$

$$\underline{b}_3'=+\tau\underline{b}_2, \tag{10}$$

where "κ" is the curvature of the wellbore defined as:

$$\kappa=\kappa(s)=|\underline{R}''(s)| \tag{11}$$

and "τ" is the torsion of the wellbore defined as $$\tau=\tau(s)=(\underline{b}_1\underline{R}''')/\kappa. \tag{12}$$

With Frenet's formula in equations (10), the course of a three-dimensional wellbore is fully described by its starting coordinates and direction and the parameters curvature κ(s) and torsion τ(s). In directional drilling practice, the curvature κ(s) is known as dog leg severity (DLS). The torsion τ(s) describes the rotation of the $b_1$- and $b_2$-axes of the moving frame b while moving along the borehole axis.

Figure 4:
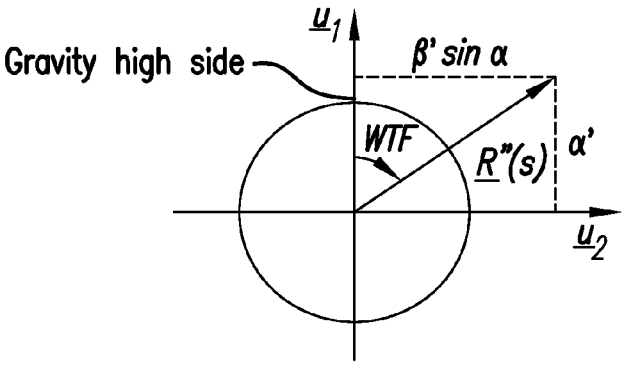
FIG. 4 is an exemplary illustration of a well tool face (WTF) angle.

Referring to FIG. 4, the borehole axis may be expressed in a coordinate system "u" based on the direction of gravity, having a unit vector $\underline{u}_1$ pointing in the direction of the gravity high side of the tool 34 at a cross section through a wellbore at the measured depth s. A unit vector $\underline{u}_3$ is the tangent vector to the borehole pointing downwards and is identical with unit vector $\underline{b}_3$. The unit vector $\underline{u}_2$ is then a vector perpendicular to $\underline{u}_1$, pointing to the right when viewing down the wellbore. Calculating the curvature vector $\underline{R}''(s)$ using the expression for b3(s)=R'(s) in equation (6) and expressing the results in the new coordinate system u yields after some coordinate transformations the simple expression:

$$\underline{R}''(s)=\alpha'\underline{u}_1+\beta'\sin\alpha\underline{u}_2 \tag{13}$$

in which "α'" and "β'" are the first derivatives of the inclination α and the azimuth angle β with respect to measured depth. α' and β' can be considered as the instantaneous build rate and the walk rate, respectively. With equation (11) the curvature, which can be defined as the dogleg severity (DLS), of the well path is then obtained as:

$$DLS=\kappa=((\alpha')^2+(\beta'\sin\alpha)^2)^{1/2}. \tag{14}$$

As an equivalent to the torsion τ in equation (12), a well tool face (WTF) angle is defined as angle between the curvature vector and gravity high side as depicted in FIG. 4:

$$WTF=\arctan((\beta'\sin\alpha)/(\alpha')). \tag{15}$$

α' and β' can then be expressed in terms of dogleg severity DLS and well tool face WTF as follows:

$$\alpha'=DLS\cos(WTF) \text{ and } \beta'=DLS\sin(WTF)/\sin\alpha. \quad (4)$$

The equations (4) allow for calculation of the rates of change in inclination and azimuth at a measured depth if the inclination α, the DLS and the WTF angle are known. Specifically for the azimuth, starting from a position with known azimuth, future azimuth values can be obtained solely on the basis of inclination, dogleg severity and well tool face.

Figure 5:
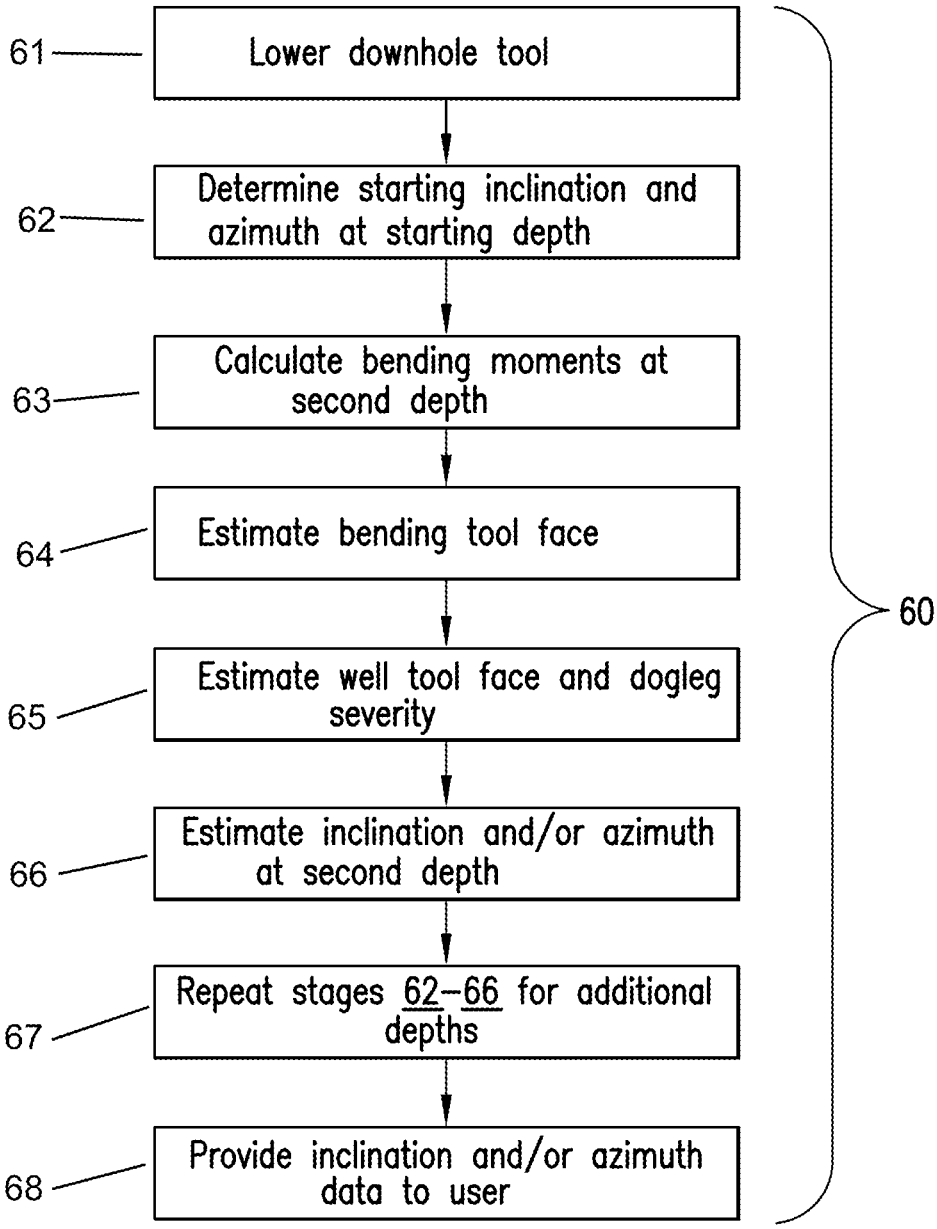
FIG. 5 is a flow chart providing an exemplary method of estimating an inclination and/or azimuth of a downhole component.
Figure 6:
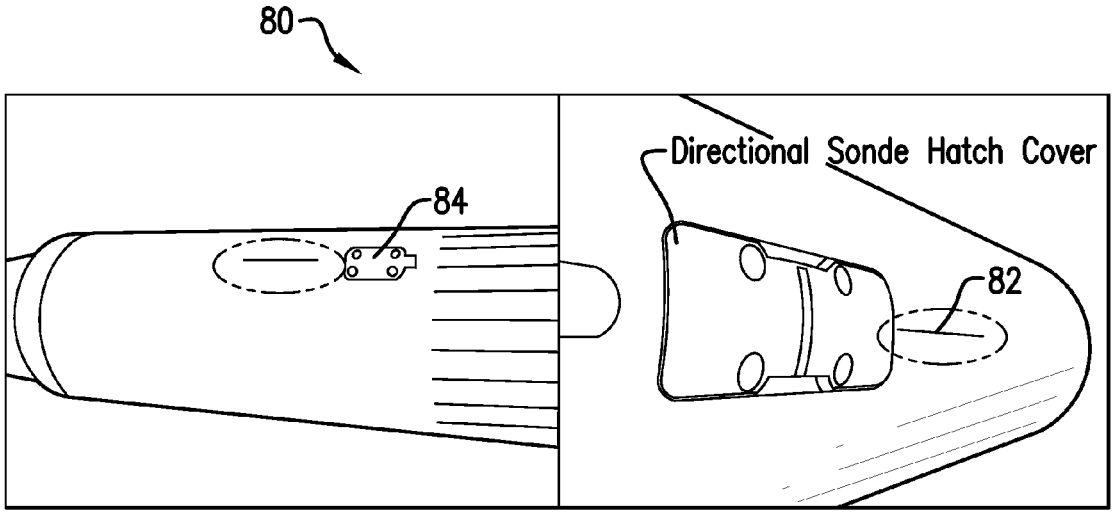
FIG. 6 is a perspective view of a downhole directional sonde.
Figure 7:
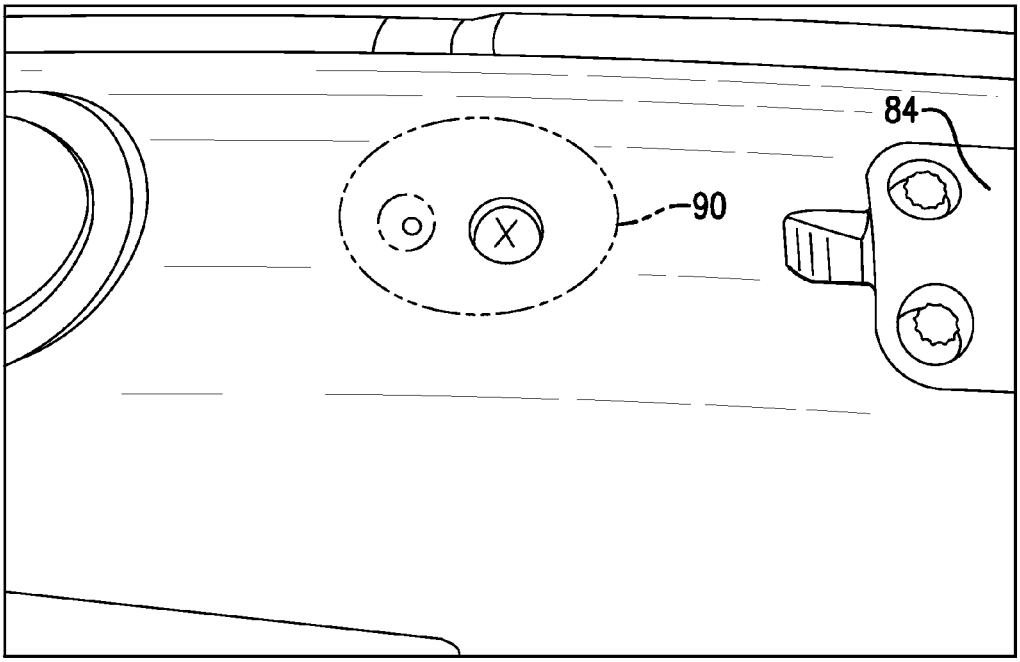
FIG. 7 is a close-up view of the directional sonde of FIG. 6.
Figure 8:
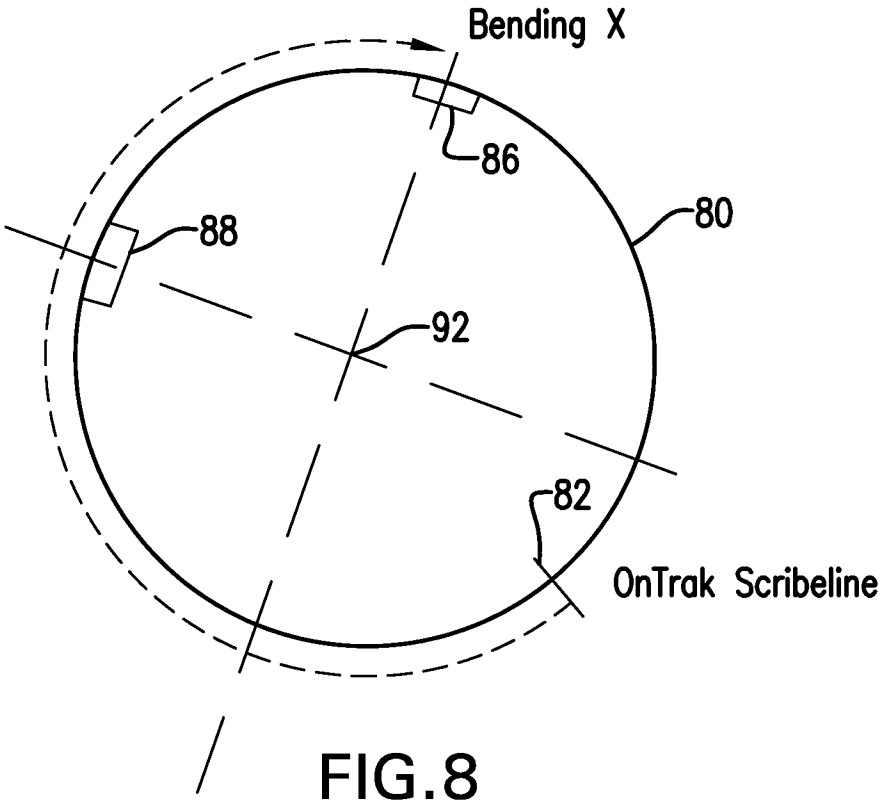
FIG. 8 is an exemplary illustration of a sensor offset angle.

Generally, some of the teachings herein are reduced to an algorithm that is stored on machine-readable media. The algorithm is implemented by a computer or processor such as the surface processing unit 42 or the tool 34 and provides operators with desired output. For example, electronics in the tool 34 may store and process data downhole, or transmit data in real time to the surface processing unit 42 via wireline, or by any kind of telemetry such as mud pulse telemetry or wired pipes during a drilling or measurement-while-drilling (MWD) operation FIG. 5 illustrates a method 60 for measuring an inclination and/or azimuth of a downhole component. The method 60 includes one or more of stages 61-68 described herein. The method may be performed repeatedly and/or periodically as desired, and may be performed for multiple depths in a selected length of the borehole 12. The method is described herein in conjunction with the downhole tool 34, although the method may be performed in conjunction with any number and configuration of processors, sensors and tools. The method may be performed by one or more processors or other devices capable of receiving and processing measurement data, such as the surface processing unit 42 or downhole electronics units. In one embodiment, the method includes the execution of all of stages 61-68 in the order described. However, certain stages 61-68 may be omitted, stages may be added, or the order of the stages changed.

In the first stage 61, the downhole tool 34, the BHA 24 and/or the drilling assembly 20 are lowered into the borehole 12 during a drilling and/or directional drilling operation.

In the second stage 62, an inclination angle "Inc_old" and an azimuth angle "Azi_old" is determined at a start position with a known measured depth (MD) referred to as "MD_old". The MD is a measured distance extending from the surface of the borehole along the borehole path to a selected location in the borehole.

In the third stage 63, the bending moment BM at one or more second measured depths relative to MD_old is measured or calculated. The difference between MD_old and the one or more second measured depths ("MD_new") defines a measured depth interval ("ΔMD"). In one embodiment, the BM is derived from perpendicularly arranged strain gauges 36 and 38, referred to as "BM_x" and "BM_y". A single BM measurement may be taken at the depth interval, or multiple BM measurements may be taken at several locations along the borehole axis within the depth interval to derive an average BM.

In the fourth stage 64, in one embodiment, the bending tool face (BTF) angle at MD_new or an average BTF over the interval ΔMD is estimated or calculated based on the BM measurements. For example, in the case of a sliding mode drilling operation, the BTF for each set of BM measurements BM_x and BM_y is calculated based on equation (2) described above:

$$BTF=GTF+TF_offset-\arctan(BM_y/BM_x). \quad (2)$$

In another example, in the case of a rotary mode drilling operation, the BTF for each set of BM measurements BM_x and BM_y is calculated based on equation (3) described above:

$$BTF=\Phi bend-\Phi accel. \quad (3)$$

In the fifth stage 65, WTF and DLS are estimated based on the BM and/or BTF calculations. In one embodiment, the WTF and/or the DLS is estimated based on a mathematical model such as a finite element model based on previous measurements of the tool 34 and/or the borehole 12. In another embodiment, the WTF angle is assumed to be the same as the BTF angle. In yet another embodiment, the BTF angle is adjusted based on deviations between the tool 34 and the borehole 12 to determine the WTF angle. The DLS may also be estimated based on BM measurements utilizing a suitable model.

In the sixth stage 66, the inclination and/or azimuth at the second measured depth MD_new, where MD_new=MD_old+ΔMD, are calculated based on equations (4). For example, the inclination at MD_new is calculated based on the following equation:

$$Inc_new=Inc_old+\Delta MD\ DLS\cos(WTF), \quad (16)$$

And the azimuth at MD_new is calculated based on the following equation:

$$Azi_new=Azi_old+\Delta MD\ DLS\sin(WTF)/\sin(Inc_old). \quad (17)$$

In the seventh stage 67, stages 62-66 may be repeated for additional depths defining additional measured depth intervals along the borehole axis extending from the starting depth. For example, to calculate the azimuth and/or inclination at a third depth downhole, equations (16) and (17) are utilized, where Inc_old is the new inclination estimated for the second depth, Azi_old is the new azimuth estimated for the second depth. In this way, one or more azimuth and or inclination measurements may be calculated over a selected length of the borehole (e.g., 1-10 feet) extending from the starting depth. In one embodiment, the azimuth and/or inclination measurements at each interval or depth are integrated to yield an azimuth and/or inclination value for a selected length of the tool 34.

In the eighth stage 68, the inclination and/or azimuth data is provided to a user and may be used to record and/or monitor the tool 34 and/or drilling or other downhole operations. In one embodiment, the data is stored in the tool 34 and/or transmitted to a processor such as the surface processing unit 42, and can be retrieved therefrom and/or displayed for analysis. As used herein, a "user" may include a drillstring or logging operator, a processing unit and/or any other entity selected to retrieve the data and/or control the drillstring 11 or other system for lowering tools into a borehole. The user may take any appropriate actions based on the inclination and/or azimuth data to, for example, change steering course or drilling parameters.

An example of a BTF calculation is shown in FIGS. 6-9. A non-rotating directional sonde 80 shown in FIGS. 6 and 7 includes a scribeline 82 and a read-out port 84. The scribeline 82 provides a reference for use in determining the angular locations of BM measurement devices in the sonde 80 or other components when downhole. The sonde 80 includes an x-axis bending moment sensor 86 (BMx sensor) and a perpendicular y-axis bending moment sensor 88 (BMy sensor). The BMx sensor has an angular position shown by a marking 90 on the sonde body.

In this example, prior to measuring the BTF, an offset of the BMx sensor is determined. The offset is the angle between the BMx sensor 86 and the scribeline 82 relative to a longitudinal axis 92 of the sonde 80. For example, the offset is determined by measuring the angle in a clockwise direction from a perspective looking downhole.

The offset is determined and entered into a processing program shown by the spreadsheet of FIG. 9. In this example, the offset is determined to be 135 degrees, which is entered into the spreadsheet. For each depth, the time, measured depth, x-axis bending moment (DBMXAX), y-axis bending moment (DBMYAX) and the high side toolface (HTFX) are entered and the program automatically calculates the BTF of the sonde 80 at the measured depth based on equation (2). In the example shown in FIG. 9, the entered DBMXAX is 5000 ft-lbs, the entered DBMYAX is −3000 ft-lbs, the HTFX is 87 degrees, and the calculated BTF is approximately −107 degrees, which indicates a bending to the left with a slight dropping tendency.

New bending moment data may be periodically (e.g., every 5 minutes) entered into the processing program, such as by entering the data into a new row in the spreadsheet. The program can then automatically calculate the BTF for data entered for each measured depth. The BTF data can be used for a variety of purposes, such as monitoring the tool face of downhole components. For example, for a drilling assembly that includes a whipstock casing, calculated BTF values that are similar to the whipstock toolface angle can be used to verify that the whipstock is oriented as expected. If the calculated BTF values deviate from the expected angles, the whipstock orientation may have shifted relative to what was expected.

The systems and methods described herein provide various advantages over prior art techniques. For example, the systems and methods allow for accurate calculation of discrete local changes in inclination and azimuth of downhole tools. This can result in more accurate directional drilling operations and improved modeling resulting in a reduction of the ellipsoids of uncertainty. In addition, magnetometers are not required at least in the non-rotating systems described herein, allowing for tools to be made from additional materials such as standard steel, and allowing for obtaining good quality azimuth data in situations with magnetic interference.

In support of the teachings herein, various analyses and/or analytical components may be used, including digital and/or analog systems. The system may have components such as a processor, storage media, memory, input, output, communications link (wired, wireless, pulsed mud, optical or other), user interfaces, software programs, signal processors (digital or analog) and other such components (such as resistors, capacitors, inductors and others) to provide for operation and analyses of the apparatus and methods disclosed herein in any of several manners well-appreciated in the art. It is considered that these teachings may be, but need not be, implemented in conjunction with a set of computer executable instructions stored on a computer readable medium, including memory (ROMs, RAMs), optical (CD-ROMs), or magnetic (disks, hard drives), or any other type that when executed causes a computer to implement the method of the present invention. These instructions may provide for equipment operation, control, data collection and analysis and other functions deemed relevant by a system designer, owner, user or other such personnel, in addition to the functions described in this disclosure.

Further, various other components may be included and called upon for providing aspects of the teachings herein. For example, a sample line, sample storage, sample chamber, sample exhaust, pump, piston, power supply (e.g., at least one of a generator, a remote supply and a battery), vacuum supply, pressure supply, refrigeration (i.e., cooling) unit or supply, heating component, motive force (such as a translational force, propulsional force or a rotational force), magnet, electromagnet, sensor, electrode, transmitter, receiver, transceiver, controller, optical unit, electrical unit or electromechanical unit may be included in support of the various aspects discussed herein or in support of other functions beyond this disclosure.

One skilled in the art will recognize that the various components or technologies may provide certain necessary or beneficial functionality or features. Accordingly, these functions and features as may be needed in support of the appended claims and variations thereof, are recognized as being inherently included as a part of the teachings herein and a part of the invention disclosed.

While the invention has been described with reference to exemplary embodiments, it will be understood by those skilled in the art that various changes may be made and equivalents may be substituted for elements thereof without departing from the scope of the invention. In addition, many modifications will be appreciated by those skilled in the art to adapt a particular instrument, situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

The invention claimed is:

1. A system for measuring directional characteristics of a downhole tool, the system comprising:

at least one bending moment (BM) measurement device disposed at a downhole component that is configured to be movable within a borehole, the at least one BM measurement device configured to generate bending moment data, the bending moment data including a bending vector of the downhole tool, a bending moment representing an amplitude of the bending vector, and a bending tool face (BTF) angle representing an orientation of the bending vector relative to gravity high side, the BTF estimated using a first calculation based on the downhole component being in a sliding mode, the BTF estimated using a second calculation based on the downhole component being in a rotary mode; and a processor in operable communication with the BM measurement device and configured to receive bending moment data from the BM measurement device for a single selected depth, calculate a dogleg severity (DLS) from the bending moment measured only at the single selected depth and a well tool face (WTF) angle from the BTF angle, and calculate a change in inclination at the selected depth based on the DLS and the WTF angle.

2. The system of claim 1, wherein the processor is configured to calculate the change in inclination via the following equation:

$$\alpha' = DLS \cos(WTF),$$

wherein $\alpha'$ is a first derivative of an inclination angle $\alpha$ at a measured depth.

3. The system of claim 1, wherein the processor is further configured to calculate a change in azimuth based on the bending moment data.

4. The system of claim 3, wherein the change in inclination is calculated relative to a known inclination angle "Inc_old" at a known measured depth "MD_old" and the change in azimuth is calculated relative to a known azimuth "Azi_old" at the MD_old, and calculating the change in inclination includes calculating an inclination "Inc_new" at a second measured depth "MD_new" based on the following equation:

$$Inc_new=Inc_old+\Delta MD\ DLS\cos(WTF),$$

wherein "ΔMD" is a difference between MD_new and MD_old.

5. The system of claim 4, wherein calculating the change in azimuth includes calculating an azimuth "Azi_new" at a second measured depth "MD_new" based on the following equation:

$$Azi_new=Azi_old+\Delta MD\ DLS\sin(WTF)/\sin(Inc_old),$$

wherein "ΔMD" is a difference between MD_new and MD_old.

6. The system of claim 3, wherein the processor is configured to calculate the change in azimuth via the following equation:

$$\beta'=DLS\sin(WTF)/\sin\alpha,$$

wherein β' is a first derivative of azimuth angle β at a measured depth, and α is an inclination angle at the measured depth.

7. The system of claim 1, wherein the at least one depth is different than a starting depth associated with at least one of a known inclination and a known azimuth, and the BTF angle is calculated based on the bending moment in the absence of any measurements of azimuth or inclination at the at least one depth.

8. The system of claim 7, wherein:

the at least one BM measurement device includes a first strain gauge configured to generate a first bending moment "BM_x", a second strain gauge oriented orthogonal to the first strain gauge and configured to generate a second bending moment "BM_y", the first and second strain gauges having an angular location around a longitudinal axis of the tool relative to a reference location, the reference location indicating a rotational orientation of the tool, and the processor is configured to calculate the BTF angle based on an offset angle between the angular location and the reference location.

9. The system of claim 1, wherein the first calculation is based on the following equation:

$$BTF=GTF+TF_offset-\arctan(BM_y/BM_x),$$

wherein "BM_x" is a first bending moment derived from a first strain gauge and "BM_y" is a second bending moment derived from a second strain gauge oriented orthogonal to the first strain gauge, "TF_offset" is an offset angle between a coordinate system of a directional sensor and a coordinate system of the first and second strain gauges, and "GTF" is a rotational orientation of the downhole component.

10. The system of claim 1, wherein the second calculation is based on the following equation:

$$BTF=\Phi bend-\Phi accel,$$

wherein "Φaccel" is a first phase angle relative to an azimuthal reference, the first phase angle estimated based on acceleration measurements, and "Φbend" is a second phase angle relative to the azimuthal reference, the second phase angle estimated based on bending measurements.

11. The system of claim 1, wherein the processor is configured to calculate an instantaneous measure of build rate and walk rate based on the DLS and the WTF angle calculated from the bending moment data measured only at the selected depth.

12. A method of measuring directional characteristics of a downhole tool, the method comprising:

disposing a downhole component in a borehole in an earth formation, the downhole component operably coupled to at least one bending moment (BM) measurement device;

generating bending moment data via the at least one BM measurement device, the bending moment data including a bending vector of the downhole tool, a bending moment representing an amplitude of the bending vector, and a bending tool face (BTF) angle representing an orientation of the bending vector relative to gravity high side, the BTF estimated using a first calculation based on the downhole component being in a sliding mode, the BTF estimated using a second calculation based on the downhole component being in a rotary mode;

receiving bending moment data from the BM measurement device for a single selected depth at a processor;

calculating a dogleg severity (DLS) from the bending moment measured only at the single selected depth, and calculating a well tool face (WTF) angle from the BTF angle; and calculating a change in inclination at the selected depth based on the DLS and the WTF angle.

13. The method of claim 12, wherein the change in inclination is calculated via the following equation:

$$\alpha'=DLS\cos(WTF),$$

wherein α' is a first derivative of an inclination angle α at a measured depth.

14. The method of claim 12, further comprising calculating a change in azimuth at the selected depth based on the bending moment data.

15. The method of claim 14, wherein the change in inclination is calculated relative to a known inclination angle "Inc_old" at a known measured depth "MD_old" and the change in azimuth is calculated relative to a known azimuth "Azi_old" at the MD_old, and calculating the change in inclination includes calculating an inclination "Inc_new" at a second measured depth "MD_new" based on the following equation:

$$Inc_new=Inc_old+\Delta MD\ DLS\cos(WTF),$$

wherein "ΔMD" is a difference between MD_new and MD_old.

16. The method of claim 15, wherein calculating the change in azimuth includes calculating an azimuth "Azi_new" at a second measured depth "MD_new" based on the following equation:

$$Azi_new=Azi_old+\Delta MD\ DLS\sin(WTF)/\sin(Inc_old),$$

wherein "ΔMD" is a difference between MD_new and MD_old.

17. The method of claim 14, wherein the change in azimuth is calculated via the following equation:

$$\beta'=DLS\sin(WTF)/\sin\alpha,$$

wherein β' is a first derivative of azimuth angle β at a measured depth, and a is an inclination angle at the measured depth.

18. The method of claim 12, wherein the at least one depth is different than a starting depth associated with at least one of a known inclination and a known azimuth, and the BTF angle is calculated based on the bending moment in the absence of any measurements of azimuth or inclination at the at least one depth.

19. The method of claim 12, wherein the WTF angle is calculated from the BTF angle based on an offset angle between the WTF angle and the BTF angle, the offset angle based on a mathematical model of the borehole.

20. The method of claim 12, wherein the DLS is calculated based on a total bending moment, and the total bending moment is calculated as a vector sum based on the following equation:

$$\text{Total BM}=((\text{BM_}x)^2+(\text{BM_}y)^2)^{1/2},$$

wherein "Total BM" is the total bending moment, "BM_x" is a first bending moment derived from a first strain gauge and "BM_y" is a second bending moment derived from a second strain gauge oriented orthogonal to the first strain gauge.

21. The method of claim 12, wherein the processor is configured to calculate an instantaneous measure of build rate and walk rate based on the DLS and the WTF angle calculated from the bending moment data measured only at the selected depth.

22. The method of claim 12, wherein the at least one BM measurement device includes a first strain gauge configured to generate a first bending moment "BM_x", a second strain gauge oriented orthogonal to the first strain gauge and configured to generate a second bending moment "BM_y", the first and second strain gauges having an angular location around a longitudinal axis of the tool relative to a reference location, the reference location indicating a rotational orientation of the tool, and the BTF angle is calculated based on an offset angle between the angular location and the reference location.

* * * * *